United States Patent [19]

Halevy

[11] Patent Number: 4,903,405

[45] Date of Patent: Feb. 27, 1990

[54] SAFETY RAZORS

[76] Inventor: Ben-Zion Halevy, 5 Alonim St., Nazaret Ilit, Israel

[21] Appl. No.: 71,376

[22] Filed: Jul. 9, 1987

[30] Foreign Application Priority Data

Aug. 7, 1986 [IL] Israel ..... 79651

[51] Int. Cl.[4] ..... B26B 71/52

[52] U.S. Cl. ..... 30/47; 30/57; 30/89

[58] Field of Search ..... 30/87–89, 30/47, 57

[56] References Cited

U.S. PATENT DOCUMENTS 4,308,663 1/1982 Ciaffone ..... 30/89 X

*Primary Examiner*—Douglas D. Watts

*Attorney, Agent, or Firm*—Fleit, Jacobson, Cohn, Price, Holman & Stern

[57] ABSTRACT

The invention relates to safety razor units of the disposable type. The razor blade cartridge, which may house one or two blades, is connected via a swivel-type hinge to a handle. The blade cartridge and the handle engage by means of a snap-action closure means. The razor unit provides a good shaving comfort; it is simple and inexpensive in production.

4 Claims, 2 Drawing Sheets

FIG. 1
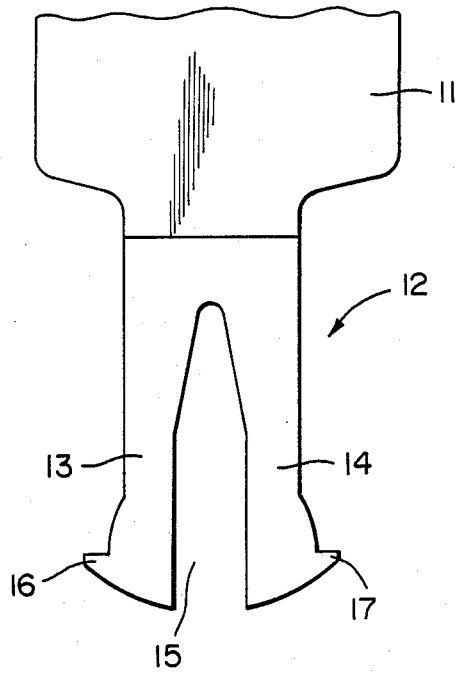
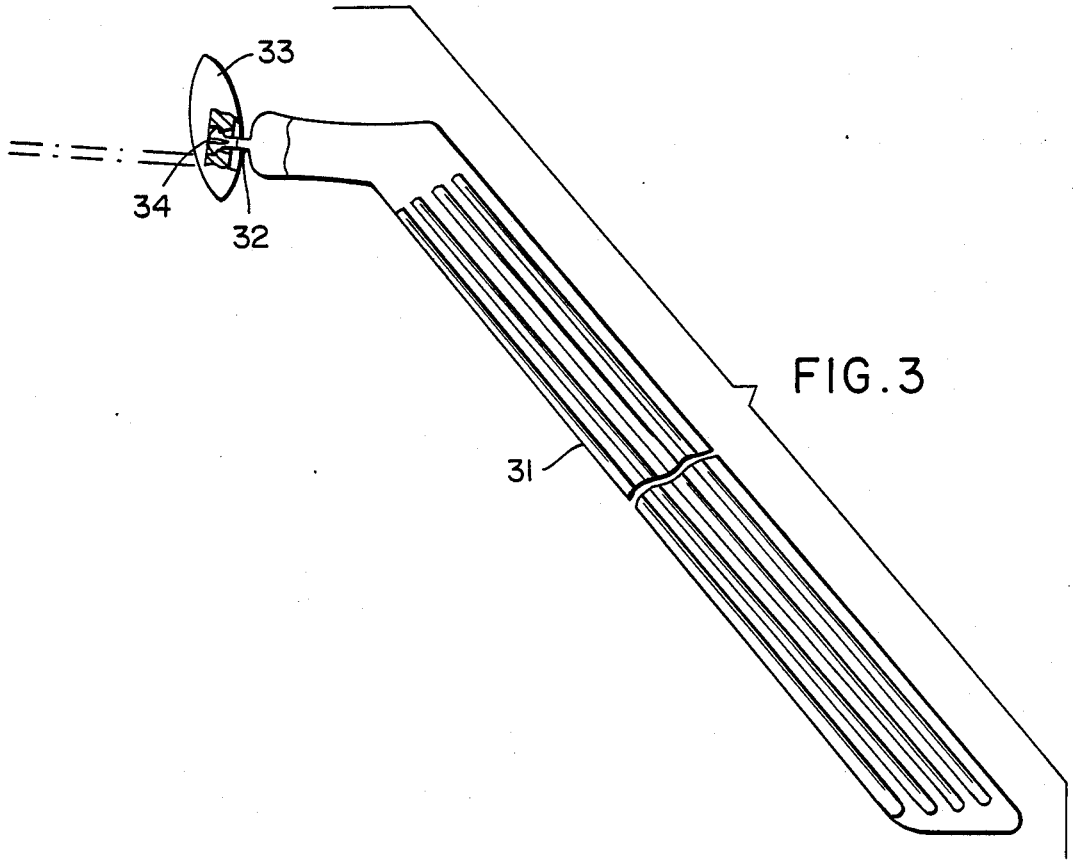
FIG. 3

FIG. 2
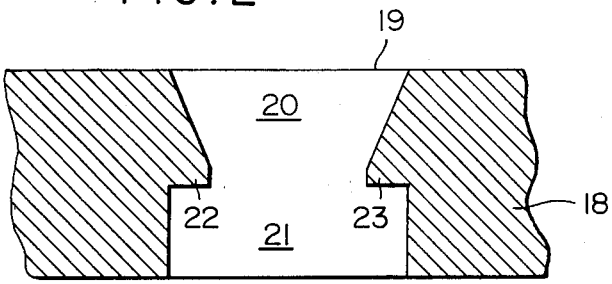
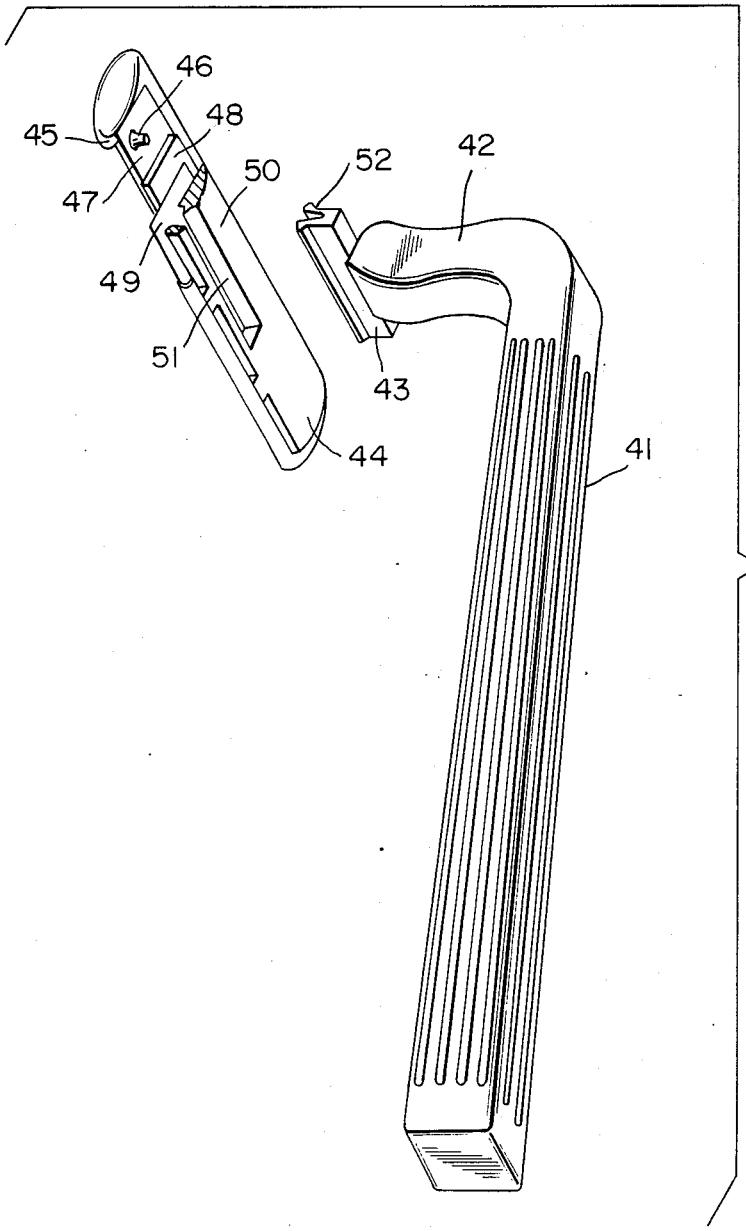
FIG. 4

SAFETY RAZORS

FIELD OF THE INVENTION:

The invention relates to improvements in disposable razors, and especially in the connection between the handle of such razor with the blade cartridge (which may be of the single- or double-blade type). There are provided novel simple connecting means between the handle and blade unit which is of a springy nature and which permits a swivel-type movement of the blade unit with respect to handle, resulting in a comfortable shave.

BACKGROUND OF THE INVENTION:

Bonded blade units wherein one or two single-edge blades are permanently held in a plastic housing have replaced to a large extent the double-edged replaceable blades used up to about 15 years ago. The bonded blades are supplied as replaceable units, which are used with handle units suited for interconnection with such blade units. A certain popular type of safety razor provides for a swivel action of the blade unit respective the handle within an angle of about 45°, improving shaving comfort. There are also provided disposable safety razors, comprising a blade unit permanently connected with a handle. Some of these have a rigid connection, whereas in others the connection is of the swivel type.

According to the present invention there is provided an improved simple disposable safety razor unit of inexpensive construction, wherein a razor blade cartridge is connected via a novel swivel-type springy hinge to a handle.

SUMMARY OF THE INVENTION:

The invention relates to novel disposable razors. These are of a simple, light-weight construction, easy to produce, and comparatively inexpensive.

The novel razors comprise a bonded razor blade unit connected to a handle, wherein the connecting member combines the functions of an axis and of a spring, which connecting member is of small dimension and facilitates the close approach of the razor blade unit to the face of the person shaving, and especially to difficult sections such as above the upper lip, etc.

The novel razor is of the swivel type and makes possible a movement of the razor unit with respect to handle, within an angle of about 45°, thus providing for improved convenience of shaving. The bonded razor blade unit is connected to the handle by the springy connecting member, which constitutes a pivot about which the bonded razor blade unit can turn within an angle of about 46°. The novel disposable safety razor can be one of the single- or double razor type.

According to the invention, the lower end of the handle terminates in an integral springy connecting member to which the bonded blade unit is attached, which connection comprises a channel-profiled member, the free edges of the said connecting member being bent outwardly of the channel and forming a tooth along each edge, which edge faces between the channel space and the extreme point of each of said teeth being curved to form a short arch, The rear member of the bonded blade unit having an elongated aperture into which the said connecting member is introduced, so connecting the two parts of the razor, forming a swivel-type connection.

In a preferred embodiment of the invention, the aperture in the blade holder is divided into two by a short web extending across the aperture while the channel profiled connecting member has a preferably V-shaped cut-out in both side walls of the channel in which at connection of the two parts the web is engaged, so orienting the bonded blade unit respective the handle during the connecting step.

DESCRIPTION OF THE PREFERRED EMBODIMENT

The invention will now be described in detail with reference to the accompanying schematical drawings which are not according to scale and in which:

FIG. 1 is a fractional side-view of the lower end of the handle of the safety razor showing the channel-profiled connecting member, in an end-view of the channel ;

FIG. 2 is a sectional fractional side-view of the rear member of the blade unit, while FIG. 3 is a side-view of assembled safety razor in partial section;

FIG. 4 is an exploded perspective view of a double-blade, disposable safety razor with the bonded double-blade unit in partial section.

As can be seen in FIG. 1, the handle part 11 terminates in connecting member 12, which forms a channel between the two side walls 13 and 14.

These latter are bent outwardly of the channel-space 15, forming oppositely directed teeth 16 and 17 at the lower end. As can be seen in FIG. 1, the edge faces of walls 13 and 14 are curved for a purpose yet to be described. The two side walls 13 and 14 are inherently springy and have the tendency of spreading apart. The unit is made from a suitable plastic. The rear member of the blade unit 18 shown in FIG. 2 (only a fraction thereof is seen in section), is a hollow body (see also FIG. 3). In the bonded blade unit, one or two razor blades (not shown) are held fixedly.

On wall of body 18 has an opening 19 (see FIG. 2), which from the outside of the body narrows inwardly (this portion being designated by numeral 20), to merge into a portion 21 which extends into the interior of the blade unit.

In order to connect the blade unit 18 to handle 11, the two walls 13 and 14 of the channel profiled member 12 are inserted into opening 19 of the blade unit. Moving inwardly, the two walls 13 and 14 are forced nearer to one another while passing through portion 20, to snap apart when arriving in portion 21, with teeth 16 and 17 becoming engaged on shoulders 22 and 23, within portion 21 of opening 20. The curved edge-faces of walls 12 and 13 now form together a rocker-like surface which lies against a counter face in the interior of the member 18, advantageously against a fixedly held blade, such that the blade unit, while being passed over a body part which is shaved, can swivellingly rock and adapt itself to curvatures of the body portion which results in a more thorough shaving.

The disposable razor unit is shown in a side-view in FIG. 3. This razor unit comprises the handle 31, terminating in the connecting member 32 according to the invention, which engages an elongated slot in the rear member of the bonded blade unit 33, which comprises one or two single-edge razor blades, the edges of whic hpoint essentially downwards, and which are not shown in this Figure.

Advantageously, the opening 20 in the blade holder is divided into two by a short web extending across the aperture (see FIG. 3) where the web is designated by numeral 34. Correspondingly, in the side walls of the channel 32, a cutout preferably V-shaped, is provided into which the web enters. In this way, the two parts are orientated relative to one another at the instant of connecting them.

As can be seen in this Figure, the swivel-type connection is such that the razor-blade unit is very close to the end of the handle, and this facilitates a close shaving by means of this type of disposable razor.

The invention is further illustrated with reference to FIG. 4. As shown in this Figure, the safety razor according to the invention, comprises a handle 41, with bent section 42, which terminates in the springy hinge member 43. The blade unit 44 comprises a bottom member 45 which supports on pins 46 (only one of these is shown), the blade 47, spacer 48 and second blade 49 (the razor illustrated is one having two blades), and upper cover member 50 wherein there is provided the elongated opening 51, which is shown in detail in FIG. 2. When the hinge member 43 is inserted into this opening 51, it spreads outwardly and cannot be removed without damaging the teeth 52 of part 43.

This assembly permits a swivel-type movement of the blade unit respective the handle, providing for great shaving comfort. It ought to be mentioned that in this specific construction, the upper and lower plastic parts are engaged by means of lateral snap-action closure connecting means.

In order to provide an idea about the dimensions, this is to point out that a model was constructed which gave good results. The length of the springy member 43 is about 2.8 mm, the width at its middle is about 0.6 mm, the overall width of the connecting member is spread-out position, is about 1.6 mm, the length of the connecting member and of the corresponding slot 51 in the blade unit is about 15 mm. The handle makes an angle of about 45° with the bent-over section, and the unit is free to move through an angle of about 46°.

I claim:

1. A disposable safety razor comprising:

a handle part, a bonded blade unit, a channel profiled connecting member having two resilient side walls and being integral with said handle part at a lower end of said handle part, the free ends of said side walls being bent outwardly from the channel formed by said connecting member and forming an outwardly extending tooth along each end, edge faces of said side walls located adjacent each of said teeth being curved to form an arch, said bonded blade unit having an aperture for introduction of said connecting member to pivotably connect said handle part and said bonded blade unit, said aperture including an inwardly narrowing portion terminating at an interiorly extending portion within which said teeth are locked after passing through said inwardly narrowing portion to move pivotably by engagement of said arch with said bonded blade unit.

2. A safety razor according to claim 1, wherein said aperture in said bonded blade unit is divided in two by a short web extending across said aperture while said channel profiled connecting member includes a V-shaped cut-out, in both side-walls of the channel so that during connection of said handle part and said bonded blade unit said web is engaged in said V-shaped cut-out, so pivotably orienting said bonded blade unit on said handle part.

3. A disposable razor unit according to claim 1, wherein said handle part and said bonded blade unit, except for blade and possible spacer means, are made of a plastic material.

4. A disposable razor according to claim 1, wherein a length of said channel-profiled member is 2.5 to 3 mm and its width is about 15 mm.

* * * * *